United States Patent [19]

McRae

[11] 4,217,186

[45] Aug. 12, 1980

[54] PROCESS FOR CHLORO-ALKALI ELECTROLYSIS CELL

[75] Inventor: Wayne A. McRae, Zurich, Switzerland

[73] Assignee: Ionics Inc., Watertown, Mass.

[21] Appl. No.: 26,268

[22] Filed: Apr. 2, 1979

Related U.S. Application Data

[62] Division of Ser. No. 942,109, Sep. 14, 1978, Pat. No. 4,173,524.

[51] Int. Cl.[2] ..... C25B 1/34

[52] U.S. Cl. ..... 204/98; 204/128

[58] Field of Search ..... 204/98, 128

[56] References Cited

U.S. PATENT DOCUMENTS

| | | | |
|---|---|---|---|
| 3,124,520 | 3/1964 | Juda | 204/98 |
| 3,282,834 | 11/1966 | Justi et al. | 204/98 |
| 3,793,163 | 2/1974 | Dotson | 204/98 |
| 4,035,254 | 7/1977 | Gritzner | 204/98 |
| 4,035,255 | 7/1977 | Gritzner | 204/98 |

*Primary Examiner*—R. L. Andrews

*Attorney, Agent, or Firm*—Norman E. Saliba

[57] ABSTRACT

An improved process and apparatus for pH control and energy savings in chlor-alkali electrolysis cells is disclosed wherein a fuel cell type spaced porous catalytic anode is utilized to chemically oxidize a controlled, sub stoichiometric amount of hydrogen to provide hydrogen ions to a recirculating anolyte. The pH is monitored and the flow of hydrogen fuel adjusted to provide a resultant desired pH in the range of about 2 to about 4. Optionally, hydrogen gas produced at the cell cathode may comprise the fuel supply and a spaced porous catalytic cathode may be employed for hydrogen supply control and depolarization.

5 Claims, 1 Drawing Figure

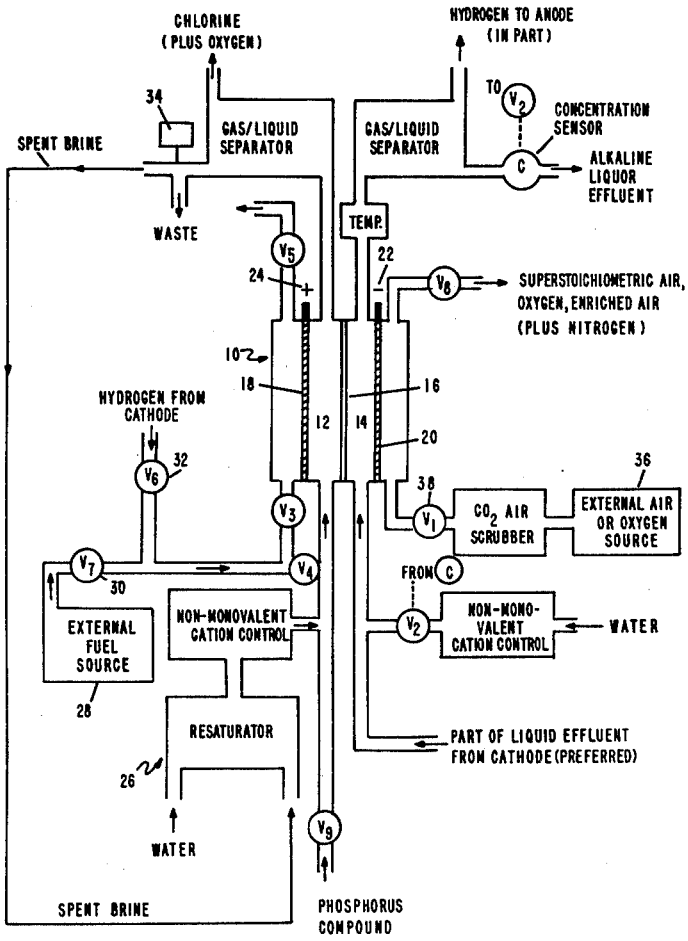

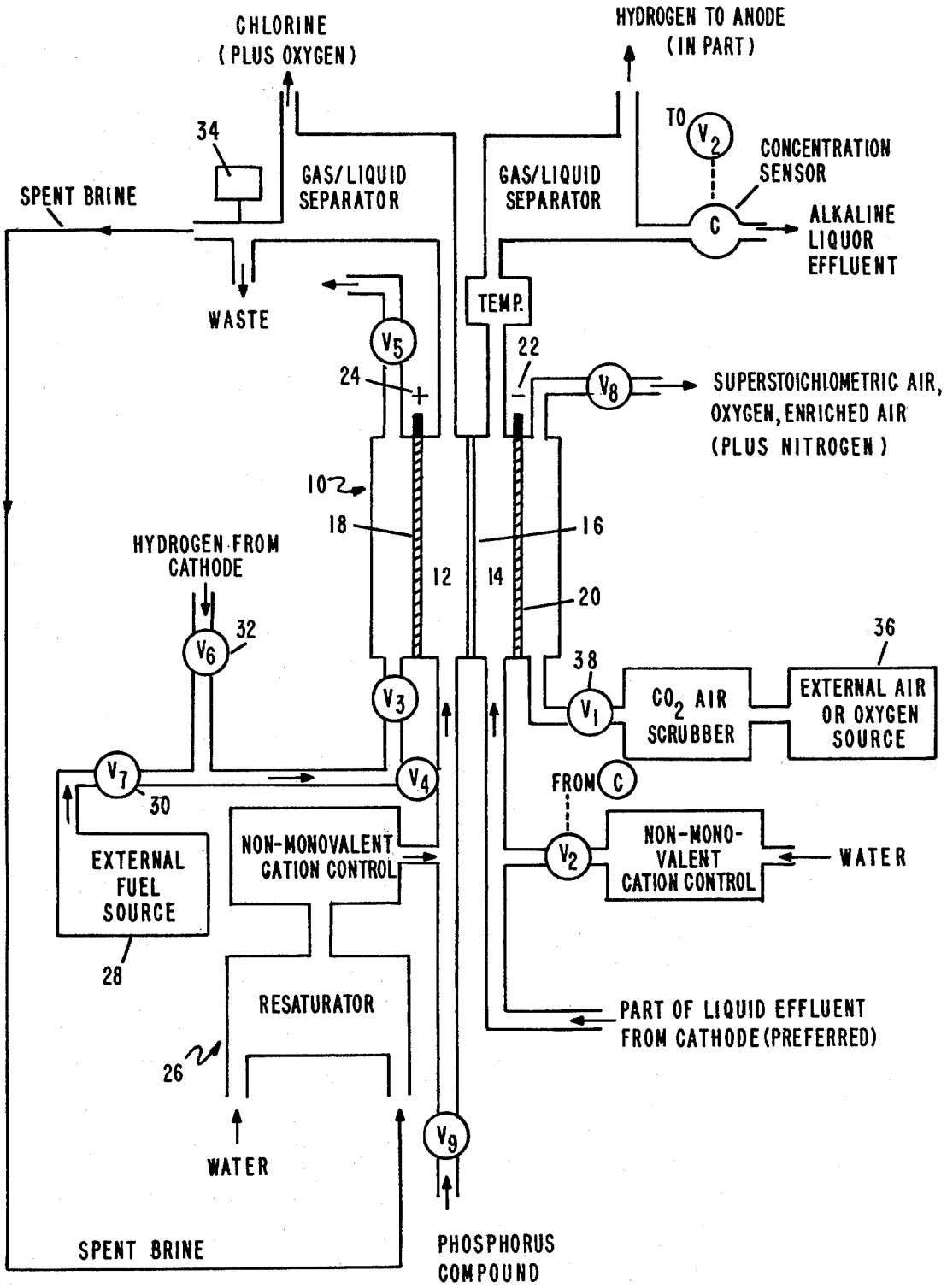
CHLORINE
(PLUS OXYGEN)
HYDROGEN TO ANODE
(IN PART)
34
GAS/LIQUID
SEPARATOR
GAS/LIQUID
SEPARATOR
TO
V2
CONCENTRATION
SENSOR
SPENT BRINE
C
ALKALINE
LIQUOR
EFFLUENT
WASTE
TEMP.
V5
22
24
V8
SUPERSTOICHIOMETRIC AIR,
OXYGEN, ENRICHED AIR
(PLUS NITROGEN)
10
18
16
HYDROGEN FROM
CATHODE
12
14
20
V6
32
36
38
V3
V1
CO2 AIR
SCRUBBER
EXTERNAL AIR
OR OXYGEN
SOURCE
V7
V4
FROM
C
30
NON-MONOVALENT
CATION CONTROL
V2
NON-MONO-
VALENT
CATION CONTROL
WATER
EXTERNAL
FUEL
SOURCE
28
RESATURATOR
PART OF LIQUID EFFLUENT
FROM CATHODE (PREFERRED)
26
V9
WATER
SPENT BRINE
PHOSPHORUS
COMPOUND

PROCESS FOR CHLORO-ALKALI ELECTROLYSIS CELL

This is a division of application Ser. No. 942,109, filed 09/14/78 U.S. Pat. No. 4,173,524.

BACKGROUND OF THE INVENTION

1. Field of the Invention

The invention resides in the field of electrolytic devices and more particularly relates to chlor-alkali or alkali metal chloride cells containing cation selective membranes.

2. Description of the Prior Art

The electrolysis of alkali metal chlorides with cation selective membranes for the production of chlorine, alkali hydroxides, hydrochloric acid and alkali hypochlorites is well known and extensively used, particularly with respect to the conversion of sodium chloride. In the sodium chloride process the electrolysis cell is divided into anolyte and catholyte compartments by a permselective cation membrane. Brine is fed to the anolyte compartment and water to the catholyte compartment. A voltage impressed across the cell electrodes causes the migration of sodium ions through the membrane into the catholyte compartment where they combine with hydroxide ions formed from the splitting of water at the cathode to form sodium hydroxide (caustic soda). Hydrogen gas is formed at the cathode and chlorine gas at the anode. The caustic, hydrogen and chlorine may subsequently be converted to other products such as sodium hypochlorite or hydrochloric acid.

The efficiency of these cells for production of caustic and chlorine depends upon how they are operated, that is, the balancing of the chemical parameters of the cell and the internal use of the products and further how the cells are contructed, i.e., what materials are used to form the components and what system flow paths are employed.

One particular concern in attaining efficiency is the control of the pH of the anolyte compartment. It is desirable to maintain the level as acidic as is necessary and sufficient to inhibit the formation of sodium chlorate and/or oxygen in the anolyte particularly where a recirculating brine feed is employed. Sodium chlorate and/or oxygen are formed when hydroxyl ions migrate from the catholyte compartment through the membrane into the anolyte compartment. Adding acid to the anolyte compartment neutralizes the hydroxyl ions and inhibits chlorate build up and oxygen evolution in a recirculating system. Such a procedure has been described in U.S. Pat. No. 3,948,737, Cook, Jr., et al, and elsewhere.

It has been recognized that the use of fuel cell type spaced porous catalytic electrodes with a surplus of available fuel may be advantageously employed in electrochemical cells of the type described for the purpose of reducing the external energy requirements of the cell. The fuel cell reaction supplies a portion of the electrical energy and reduces in part the necessity for supplying external energy for the formation of gaseous products. This concept has been extensively examined in U.S. Pat. No. 3,124,520, Juda. The product of the cell is hydrochloric acid rather than chlorine.

In that patent, the use of gas electrodes in a chlor-alkali type cell is described. The anode is composed of a water-proofed, porous conductor capable of activating a surplus of a combustible fuel such as hydrogen gas. An aqueous solution of sodium chloride or brine forming an anolyte is introduced into the anode compartment. The porous fuel anode functions as an agent for releasing into the anolyte hydrogen ions which in conjunction with the chloride ions supplied by the sodium chloride form hydrochloric acid. The latter is then withdrawn from the cell. Substantial amounts of chlorine gas are not formed. The hydrogen supplied to the anode may be obtained from the cathode where hydrogen is formed as a result of the electrolytic breakdown of water in the cathode compartment.

The present invention comprises an improvement over the above discussed prior art techniques particularly as applied to large volume production chlor-alkali cell apparatus where conservation of energy and utilization of process products and raw materials are important considerations in the economic feasibility of such units. In the method of the invention, this is accomplished by measuring the pH of the anolyte, passing a controlled substoichiometric amount of hydrogen to a spaced porous catalytic anode and controlling the pH of the effluent from the anolyte to the range of 2 to 4 by controlling the rate of hydrogen feed, thereby maximizing the efficiency of the cell. The advantages and features of the improvement will become apparent from the following summary.

SUMMARY OF THE INVENTION

The invention may be summarized as an improved method and apparatus for controlling and maintaining the pH of a recirculating anolyte for a membrane-type chlor-alkali electrolysis cell, particularly a cell suited for converting sodium chloride or brine to sodium hydroxide or caustic. A spaced porous catalytic anode is employed to absorb a substoichiometric amount of a fuel such as hydrogen and effect the transfer of hydrogen ions into the anolyte. By monitoring the pH of the anolyte, the fuel supply may be controlled and introduced to the anode in a measured amount. One source of hydrogen is that produced by the cell itself at the cathode and this may be fed directly to the anode to accomplish the control.

Optionally, and in combination with the above, the cathode may similarly consist of a suitable spaced porous catalytic material which will act to reduce an air enriched air or oxygen feed to hydroxide ions in the presence of the water in the cathode. The concentration of alkali in the effluent is controlled.

Controlling the pH of the anolyte in the above manner yields several advantages. In a recirculating cell of this type it is important not to contaminate the brine saturated anolyte with unwanted sodium chlorate which will form and accumulate if the hydroxyl ion leakage from the catholyte through the cell membrane into the anolyte is not neutralized. Adding an acid such as HCl from an external source in the prior art manner will increase the cost of and reduce the economic feasibility of the process. Adding a stoichiometric excess of fuel to a catalytic anode for the purpose of creating the acid internally will similarly increase the cost if the resultant pH is below that which is required to efficiently operate the cell, frequently decreasing the amount of chlorine produced substantially.

Further, a lower pH than is necessary may contribute to reduced alkali current efficiency and to the degradation of the cell itself depending upon the construction materials.

Obviously, the reverse of the above is true if the pH is higher than is required, that is, oxygen will be evolved and/or sodium chlorate will form in the recirculating anolyte decreasing cell efficiency.

The construction and operation of the cell comprising the invention will be more fully explained in the description of a preferred embodiment taken in conjunction with the drawing which follows:

DESCRIPTION OF THE DRAWING

The FIGURE is a schematic representation of a preferred embodiment of the invention, showing various preferred methods of operation.

DESCRIPTION OF A PREFERRED EMBODIMENT

Referring to the FIGURE, there is shown a schematic representation of an electrolysis cell 10 suitable for the practice of the invention. The cell comprises an anolyte compartment 12 and a catholyte compartment 14 separated by a cation perselective membrane 16. Anode 18 is comprised of a spaced porous material such as graphite or titanium having a catalyst such as platinum or ruthenium oxide deposited theron. Cathode 20 may be a conventional steel or nickel cathode or optionally a spaced porous type such as porous carbon having a silver oxide or colloidal platinum catalyst. Other types of catalytic electrodes well known in the art may be used. The membrane may be composed of a conventional cation exchange membrane material such as is well known in the art or preferably of a perfluorinated carboxylic or acid type such as is manufactured by E.I. duPont deNemours and Co., Inc. under the trademark NAFION ®. A voltage is impressed on the electrodes through lines 22 and 24 from a source not shown.

The anolyte (a concentrated substantially saturated brine solution) may be constantly recirculated and replenished by means 26 shown schematically and composed of apparatus as would be obvious to those skilled in the art or passed through the anolyte compartment on a "once-through" basis.

In the operation of the cell, water (or dilute sodium hydroxide) is normally fed to the catholyte compartment from a source not shown and sodium hydroxide (formed from sodium ions from the anolyte and hydroxide ions from the cathode) is withdrawn by means also not shown. The catholyte may be operated on a once-through or on a recirculation basis. If a highly concentrated caustic solution is desired, the cell may be operated without a water feed to the cathode chamber. In such case the required water will be supplied to the catholyte solely by water transfer through the cation membrane. Hydrogen is evolved at the cathode and chlorine (with small amounts of oxygen) at the anode. Although membrane 16 is a cation permselective membrane, some hydroxide ions will still migrate into the anolyte resulting in the formation of sodium chlorate and oxygen unless inhibited by a similar supply of hydrogen ions.

The inhibition may be accomplished by introducing acid directly into the anolyte according to the prior art, or by the method of the present invention by supplying anode 18 with a substoichiometric amount of fuel, preferably hydrogen, from either an external source 28 or from the catholyte compartment 14. The quantity of hydrogen so admitted is controlled by valves 30 or 32. If desired both sources may be employed.

The pH of the anolyte is monitored by a pH meter 34. The pH may thus be controlled by adjusting the supply of hydrogen by adjusting valves 30 and/or 32.

Optionally a catalytic cathode may be employed supplied by an external source of oxygen enriched air or air 36. The amount of oxygen introduced is controlled by valve 38. The cathode will catalytically promote the combination of oxygen with water to produce hydroxide ions, the amount of hydrogen evolved around the cathode will thus be reduced and as a result the electrode will be depolarized. Further the amount of hydrogen in the catholyte which is available to the anode will be reduced allowing the reaction to act as an additional control of the pH. The amount of hydrogen removed will depend upon the amount of oxygen available and therefore the setting of valve 38.

The operation and concept of the invention will be further understood from the following examples.

EXAMPLE 1

This example illustrates a preferred operation in accordance with this invention but without pH control of the anolyte. An electrolyte cell is constructed in accordance with FIG. 1. The membrane is a perfluorosulfonic acid type furnished by the E.I. duPont deNemours Co., Inc. under the tradename NAFION ® and consists of a thin skin having an equivalent weight of about 1350 laminated to a substrate having an equivalent weight of about 1100. The membrane is reinforced with a woven polyperfluorocarbon fabric manufactured by the duPont Co. under the tradename TEFLON ®. The effective area of the membrane is about 1 square decimeter. A perfluorocarboxylic acid membrane, such as that manufactured by the Asahi Chemical Industry Co. of Tokyo may also be used. The cathode is woven nickel wire mesh; the anode is a woven titanium wire mesh which has been coated on the fact adjacent to the membrane with several layers of finely divided ruthenium oxide powder, baked at an elevated temperature to promote adhesion to the mesh as is well known in the art. The electrodes also have apparent areas of about 1 square decimeter. The electrodes are spaced from the membrane to permit gas evolution and disengagement. Sodium chloride brine, substantially saturated, is fed to the anode compartment at a rate of about 300 cubic centimeters per hour. The effluent from the anode compartment is separated into a gas stream and a liquid stream. From about 1 to about 10 percent of the effluent liquid stream is sent to waste; the remainder with additional water is resaturated with salt and used as feed to the anode compartment.

About 5 percent sodium hydroxide is fed to the cathode compartment. The feed rate is adjusted to produce an effluent from the cathode compartment having a concentration of about 10 percent. The effluent from the cathode compartment is also separated into a gas stream and a liquid stream. Part of the liquid stream is diluted with water and used as feed to the cathode compartment.

After the flows to the electrode compartments have been established, a direct current of about 25 amperes is imposed on the cell. After several hours, the voltage of the cell stabilizes at about 4.5 volts. The temperature of the effluents from the cell are adjusted to about 80° C. by controlling the temperatures of the feeds to the electrodes.

The gas stream separated from the effluent from the anode compartment is analyzed by absorption in cold sodium hydroxide and titration of the latter for available chlorine. The current efficiency for chlorine evolution is found to be about 85 percent. The pH of the liquid stream separated from the effluent from the anode compartment is found to be substantially greater than 4.

EXAMPLE 2

This example illustrates the improvements which can be obtained from a preferred embodiment of the present invention but using anolyte pH control in accordance with the invention. The cell of Example 1 was used. The cell is operated as described in Example 1 except part of the gas separated from the effluent from the cathode compartment is admitted to the brine feed to the anode compartment. The rate of admission of the gas (substantially pure, but humid hydrogen) is adjusted to maintain the pH of the liquid separated from the effluent from the anode compartment in the range of from about 2 to about 4. After several hours the voltage of the cell stabilizes at about 4.5 volts.

The gas stream separated from the effluent from the anode compartment is analyzed as described in Example 1. The efficiency for chlorine evolution is found to be in the range of about 90 to about 95 percent; higher values being associated with low pH's in the range.

EXAMPLE 3

This example illustrates the improvements which can be obtained from another embodiment of the present invention. The cell of Example 1 was used. The face of the anode which is not adjacent to the membrane is thinly painted with a dilute dispersion of colloidal polyperfluoroethylene and baked to cause the polyperfluoroethylene to adhere to the electrode. The electrode is tested for its permeability to brine under a head of a few inches of brine. Any areas which allow brine to pass are again painted and the electrode is then again baked. This procedure is repeated until the electrode is not permeable to water while still retaining permeability to gas.

The cell is operated as described in Example 1 except part of the gas (substantially humid hydrogen) separated from the effluent from the cathode compartment is admitted to the waterproofed (back) face of the anode. The rate of admission of hydrogen is adjusted to maintain the pH of the liquid separated from the effluent from the anode compartment in the range from about 2 to about 4. After several hours the voltage of the cell stabilizes at about 4.5 volts.

The gas stream separated from the effluent from the anode compartment is analyzed as described in Example 1. The efficiency for chlorine evolution is found to be about 90 to 95 percent; higher values being associated with low pH's in the range.

EXAMPLE 4

This example illustrates the improvements which can be obtained from a third preferred embodiment of the invention.

The cell of Example 1 was used. the cathode was coated thinly with a paste prepared from colloidal platinum, lamp black and a dispersion of polyperfluoroethylene. The electrode is baked under a combination of time, temperature and pressure sufficient to cause the polyperfluoroethylene to bond the platinum and carbon to each other and to the metal substrate while allowing the structure to remain permeable to gas. Coatings of about 0.5 mm thickness on each side of the electrode are satisfactory. The amount of poly perfluoroethylene in the mixture should be sufficient to bind the ingredients and to prevent permeation of approximately 10 percent sodium hydroxide through the electrode under a head of a few inches of water but there is no advantage to using more than such amount of polyperfluoroethylene. The principal function of the lamp black is to dilute the colloidal platinum and provide electrical conductivity; that is to act as a carrier for the platinum. Other electrically conducting carbons or graphites can be used in place of lamp black. It is found that an effective electrode can be obtained even when the colloidal platinum has been diluted to such an extent that the electrode has less than 0.1 grams of colloidal platinum per square decimeter if the carbon or graphite is electrically conducting.

The cell is operated as described in Example 1 except that air which has been scrubbed with dilute caustic to remove carbon dioxide is admitted to the face of the cathode which is not adjacent to the membrane. The amount of air is adjusted to be in the range of from about 3 to about 8 times stoichiometric, in this example in the range of from about 80 to about 210 liters per hour. After several hours the voltage of the cell stabilizes at about a half volt less than is found in Example 1. The temperature of the cell is controlled to be greater than 70° C. The current efficiency for chlorine evolution is found to be about 85 percent. The pH of the liquid stream separated from the effluent from the anode compartment is found to be substantially greater than 4. When hydrogen from an external source is admitted to the brine feed to the anode compartment at a substoichiometric rate sufficient to control the pH of the liquid separated from the effluent from the anode compartment in the range of from about 2 to about 4, then it is found, after steady state operation, that the efficiency for chlorine evolution is in the range of about 90 to 95 percent.

Preferably the rate of addition of dilute sodium hydroxide to the air scrubber is such that the liquid effluent from the scrubber is substantially sodium carbonate. It is found that the operation of the cell is not stable unless:

(a) substantially all of the carbon dioxide is removed from the air;

(b) the water used to dilute the caustic fed to the catholyte compartment is substantially free of carbon other than monovalent cations;

(c) the brine fed to anolyte compartment is substantially free of cations other than monovalent cations. (Each of such nonmonovalent cations should be less than 5 parts per million and preferably 1 part per million or less.)

(d) several parts per million (calculated on the amount of brine fed) of a phosphorous containing compound is fed to the anode compartment, which compound can form gelatinous calcium phosphate in the presence of calcium ions under the conditions prevailing in the anode compartment. Such compounds include (without limitation): orthophosphoric acid, pyrophosphoric acid, metaphosphoric acid, hypophosphoric acid, ortho phosphorous acid, pyrophophorous acid, metaphosphorous acid, hypophosphorous acid and their salts or acid-salts with monovalent cations such as sodium and potassium; the salts or acid-salts of polyphosphoric acids such as sodium tripolyphosphate, sodium tetrametaphosphate, sodium hexametaphosphate;

phosphine; sodium phosphide; phosphonium chloride, phosphonium sulfate, phosphorus trichloride, phosphorous pentachloride; colloidal phosphorus.

It is also found that a similar reduction in voltage can be obtained when the colloidal platinum used in the cathode is replaced with other colloidal metals such as palladium, ruthenium, rhodium, iridium, nickel or mixtures or alloys of such metals with each other. Similar results are obtained when the cathode is replaced with one of the same projected area prepared by partially sintering Raney nickel and waterproofing the face in contact with the gas.

It is found that the desired reduction in cell voltage cannot be obtained if the temperature of the effluent from the cathode compartment is substantially less than 70° C.

EXAMPLE 5

The cell of Example 4 is operated as described therein except the gas fed to the cathode contains about 90 percent oxygen on a dry basis (the remainder being principally nitrogen) and is substantially free of carbon dioxide. The feed rate is about 105 percent of stoichiometric, that is, about 6.1 liters per hour, the excess being vented from the cell. The liquid effluent from the cathode compartment is maintained at a temperature of at least 70° C. and a concentration of at least 8 percent by weight. It is found that compared with Example 4 the cell voltage is about 0.2 volts less.

EXAMPLE 6

The cell of Example 4 is used. Air is compressed to a pressure of about 3 atmospheres gauge and brought into contact with thin oxygen selective membranes. The membranes are silicone rubber, about 0.1 millimeters in thickness in the form of rectangular envelops open at one end. A non-woven flexible polyethylene screen about 1 millimeter in thickness is inserted in the envelop and the open end cemented into a slot in the tube permitting free gas passage from the interior of the envelop to the interior of the tube but not from the exterior of the envelop into the tube. A second piece of screen is placed against one face of the membrane envelop and the resulting sandwich is rolled around the tube to form a spiral. The second piece of screen is cut sufficiently long that it forms the final wrap of the spiral. The ends of the central tube are threaded. The spiral and central tube are placed in a loose fitting second tube having flanges at each end. Gasketed flanges are placed on each end of the second tube. Each flange has a threaded central opening which is screwed onto the central tube and a second threaded opening which communicates with the spirally wound oxygen permeable membranes. The gasketed flanges are bolted to the flanged second tube. A flow control valve is threaded onto one of the second threaded openings and the compressed air is admitted into the other such opening. The flow opening valve is adjusted so that about one-third of the compressed air passes through the membrane, the remaining two-thirds exiting through the valves. The total area of the membrane is about 20 square feet. The total volume of gas passing through the membrane is about 18 liters per hour. It is found to contain about 35 to 40 percent oxygen and is sent to the cathode compartment of the electrolytic cell. The excess gas is bled from the cell. The liquid effluent from the cathode compartment is maintained at a temperature of at least 70° C. and a concentration of at least 8 percent by weight. It is found that compared with Example 4 the cell voltage is about 0.1 volts less.

It is found that blends of silicone rubber with other polymers for example with polycarbonate polymers can be used instead of silicone rubber or that the silicone rubber can be coated on a thin woven fabric such as nylon without substantially decreasing the performance of the system.

Since certain changes may be made in the above apparatus and methods without departing from the scope of the invention herein involved, it is intended that all matter contained in the above description as shown in the accompanying drawing shall be interpreted as illustrative and not in a limiting sense.

Fuel cell electrodes and methods for preparing the same employing colloidal platinum are more fully disclosed in U.S. Pat. Nos. 3,992,331, 3,992,512, 4,044,193, 4,059,541, 4,082,699 and others.

The embodiments of this invention in which an exclusive property or privilege is claimed are defined as follows:

1. In the process for manufacturing caustic and chlorine which comprises recycling as an anolyte feed solution a substantially saturated aqueous alkali metal chloride solution into the anode compartment of a cell, said cell having an anode compartment containing an anode, a cathode compartment containing a cathode which is catalytic for the reduction of oxygen and a substantially fluid impermeable, cation permselective fluorocarbon membrane separating said anode and cathode compartments, passing a direct electric current between said anode and said cathode and recovering elemental chlorine from said anode compartment substantially equivalent chemically to the alkali recovered from said cathode compartment, the improvement which comprises:

(a) contacting said cathode with a quantity of a substantially carbon dioxide free gas selected from the group consisting of oxygen, air and mixtures thereof, which quantity is substantially more than that chemically equivalent to the amount of direct current passed;

(b) maintaining the liquid immediately effluent from said cathode compartment at a concentration of at least about 8 percent by weight and at a temperature of at least about 70° C. thereby readily causing said gas to react with water at said catalytic cathode to produce hydroxide ions and to substantially completely inhibit the formation of hydrogen gas at the cathode;

(c) recovering at least about 90 percent of the liquid effluent from said anode compartment and adding water and alkali chloride salt to produce a substantially saturated brine solution;

(d) adjusting the concentration of any non-monovalent metallic cation in said saturated brine solution to a concentration of not more than about 5 parts per million thereby producing said anolyte feed solution;

(e) maintaining the pH of the liquid effluent from said anode compartment in the range of from about 2 to about 4 thereby controlling the formation of chlorate in the anode compartment.

2. In the process for manufacturing caustic and chlorine which comprises recycling as an anolyte feed solution a substantially saturated aqueous alkali metal chloride solution into the anode compartment of a cell, said cell having an anode compartment containing a catalytic anode, a cathode compartment containing a cathode and a substantially fluid impermeable, cation permselective fluorocarbon membrane separating said anode and cathode compartments, passing a direct electric current between said anode and said cathode and recovering elemental chlorine from said anode compartment substantially equivalent chemically to the alkali recovered from said cathode compartment, the improvement which comprises:

(a) maintaining the liquid immediately effluent from said cathode compartment at a concentration of at least about 8 percent by weight and at a temperature of at least about 70° C.;

(b) recovering at least about 90 percent of the liquid effluent from said anode compartment and adding water and alkali chloride salt to produce a substantially saturated brine solution;

(c) adjusting the concentration of any non-monovalent metallic cation in said saturated brine solution to a concentration of not more than about 5 parts per million thereby producing said anolyte feed solution;

(d) reacting at said anode a quantity of combustible gas, which quantity is not substantially more than that chemically equivalent to the amount of hydroxide ion penetrating said membrane from the cathode compartment to the anode compartment;

(e) controlling the quantity of said combustible gas to produce a pH in said liquid effluent from the anode compartment in the range from about 2 to about 4 thereby controlling the formation of chlorate in the anode compartment.

3. The process of claim 2 wherein said chloride comprises sodium chloride and said combustible fuel comprises hydrogen.

4. The process of claim 7 wherein at least part of said hydrogen comprises the hydrogen which emanates from said cathode during said process.

5. The process of claim 2 wherein said cathode comprises a catalytic oxygen electrode and said process further includes the step of passing a gas selected from the group consisting of air and oxygen and mixtures thereof in contact with said catalytic electrode to reduce the amount of hydrogen formed at said cathode.

* * * * *